US009310096B2

(12) United States Patent
Schreiber

(10) Patent No.: US 9,310,096 B2
(45) Date of Patent: Apr. 12, 2016

(54) OVERHEAD SUPPORT SYSTEM HAVING ADJUSTABLE LIGHTING ELEMENTS

(71) Applicant: Nortek Air Solutions, LLC, Eden Prairie, MN (US)

(72) Inventor: Kevin Joseph Schreiber, Happy Valley, OR (US)

(73) Assignee: Nortek Air Solutions, LLC., Eden Prairie, MN (US)

( * ) Notice: Subject to any disclaimer, the term of this patent is extended or adjusted under 35 U.S.C. 154(b) by 0 days.

(21) Appl. No.: 13/973,534

(22) Filed: Aug. 22, 2013

(65) Prior Publication Data

US 2015/0055323 A1 Feb. 26, 2015

(51) Int. Cl.

| | |
|---|---|
| ***F21V 33/00*** | (2006.01) |
| ***F24F 13/078*** | (2006.01) |
| ***F21K 99/00*** | (2010.01) |
| ***F21S 8/06*** | (2006.01) |
| ***F21V 21/30*** | (2006.01) |
| *F21W 131/205* | (2006.01) |
| *F21Y 101/02* | (2006.01) |

(52) U.S. Cl.

CPC ..... *F24F 13/078* (2013.01); *F21K 9/00* (2013.01); *F21S 8/06* (2013.01); *F21V 21/30* (2013.01); *F21W 2131/205* (2013.01); *F21Y 2101/02* (2013.01)

(58) Field of Classification Search

CPC ..... F21S 8/003; F21S 8/043; F21S 8/046; F21S 8/066; F21S 8/063; F21S 8/06; E04B 9/006; F21W 2131/205; F21W 2131/2015; F21Y 2101/02; F24F 13/078; F21V 21/30

USPC ..... 362/96

See application file for complete search history.

(56) References Cited

U.S. PATENT DOCUMENTS 5,526,245 A * 6/1996 Davis et al. ..... 362/233
5,794,397 A 8/1998 Ludwig (Continued)

FOREIGN PATENT DOCUMENTS

EP EP-2623849 A1 8/2013
WO WO-03/072995 A1 9/2003
WO WO-2015027069 A1 2/2015

OTHER PUBLICATIONS

Skytron, ARGOS II Series Lighting Fixture, TEC-B-0047 REV1, Mar. 2011.

(Continued)

*Primary Examiner* — Evan Dzierzynski
*Assistant Examiner* — Matthew Peerce
(74) *Attorney, Agent, or Firm* — Schwegman Lundberg & Woessner, P.A.

(57) ABSTRACT

An overhead support system is configured to be positioned within a room. The system may include a main housing that includes at least a portion of an air-delivery sub-system, a plurality of lighting elements secured to the main housing, a light control unit in communication with each of the plurality of lighting elements, and a light operation interface in communication with the light control unit. Each of the plurality of lighting elements is configured to move relative to the main housing. The light control unit controls operation of each of the plurality of lighting elements. The light operation interface is configured to be used to move the plurality of lighting elements relative to the main housing to focus emitted light on a target location within the room.

23 Claims, 7 Drawing Sheets

(56) References Cited

U.S. PATENT DOCUMENTS

| | | | | |
|---|---|---|---|---|
| 6,096,025 | A * | 8/2000 | Borders | 606/1 |
| 6,471,363 | B1 * | 10/2002 | Howell et al. | 362/11 |
| 7,527,468 | B2 | 5/2009 | Hopkins | |
| 7,597,534 | B2 | 10/2009 | Hopkins | |
| 7,922,442 | B2 | 4/2011 | Hopkins | |
| 8,057,069 | B2 * | 11/2011 | Mangiardi et al. | 362/272 |
| 8,087,877 | B2 | 1/2012 | Hopkins | |
| 2002/0015296 | A1 * | 2/2002 | Howell et al. | 362/11 |
| 2002/0064038 | A1 * | 5/2002 | Kummerfeld | 362/33 |
| 2009/0318772 | A1 | 12/2009 | Marka et al. | |
| 2009/0323358 | A1 * | 12/2009 | Scott | 362/373 |
| 2010/0051563 | A1 | 3/2010 | Schreiber | |
| 2010/0327766 | A1 * | 12/2010 | Recker et al. | 315/291 |
| 2011/0014061 | A1 | 1/2011 | Hopkins | |
| 2011/0015492 | A1 * | 1/2011 | Mangiardi | 600/249 |
| 2011/0097986 | A1 | 4/2011 | Cursetjee | |
| 2011/0255704 | A1 | 10/2011 | Hopkins | |
| 2012/0007516 | A1 * | 1/2012 | Lax et al. | 315/201 |
| 2012/0044670 | A1 * | 2/2012 | Piepgras et al. | 362/149 |
| 2012/0141950 | A1 * | 6/2012 | Ahearn et al. | 433/29 |
| 2013/0155672 | A1 * | 6/2013 | Vo et al. | 362/233 |
| 2013/0182417 | A1 * | 7/2013 | Amat Girbau et al. | 362/147 |
| 2014/0191100 | A1 * | 7/2014 | Cursetjee et al. | 248/327 |
| 2014/0293038 | A1 * | 10/2014 | Delmonico et al. | 348/82 |

OTHER PUBLICATIONS

American Shared Hospital Services, "OR21®" [online] [retrieved on Aug. 22, 2013 from www.ashs.com/or21.html].

"International Application Serial No. PCT/US2014/052108, International Search Report mailed Nov. 28, 2014", 5 pgs.

"International Application Serial No. PCT/US2014/052108, Written Opinion mailed Nov. 28, 2014", 7 pgs.

* cited by examiner

OVERHEAD SUPPORT SYSTEM HAVING ADJUSTABLE LIGHTING ELEMENTS

BACKGROUND OF THE DISCLOSURE

Embodiments of the present disclosure generally relate to overhead support systems, such as used with ceilings and plenums, and, more particularly, to overhead support systems having adjustable lighting elements.

Certain interior environments, such as clean rooms, hospital-like operating rooms, radiology rooms, and dental suites, utilize extremely clean air in order to protect target sites and work therein. Electronic equipment may generate heat. As such, systems may be used that concentrate cool air within the vicinity of the heat-generating equipment. Individuals, such as surgeons, may also prefer to have available additional heated or cooled air in the immediate vicinity of an operating table in order to hold a patient at a stable temperature or dissipate the excess heat created by bright lamps or a team of doctors and nurses surrounding the patient.

In modern operating rooms, equipment such as robotic surgical aids may be used. The surgical aids typically make surgery more precise and less prone to errors caused by the inherent fallibility of human hands. Additionally, even in typical clean environments, there may be a significant need for overhead-supported equipment, such as light boom assemblies, automated material handling systems, and the like. Typically, such equipment is hung from the building structure and descends through the ceiling in order to preserve valuable floor space.

A boom assembly may be supported from a ceiling. For example, in a medical environment, an articulated boom assembly may extend from a ceiling of an operating environment. Ventilation equipment, such as air diffusers, may be positioned within the ceiling and configured to direct air flow over the operating environment. However, the articulated boom assembly, and equipment secured to a distal end of the articulated boom assembly, may be disposed within an airflow path between the ceiling and the operating environment.

Typically, a lighting assembly in a surgical space is supported by a movable boom. Healthcare professionals, such as surgeons and nurses, physically move the entire lighting assembly to illuminate a target area for surgery, for example. However, as the boom assembly is moved, the lighting assembly may be disposed between the surgical environment and an air delivery outlet within the ceiling. As such, the boom assembly may block air delivery to the target surgical site. In general, airflow to the operating environment may be at least partially blocked by the lighting assembly and boom. Moreover, as the airflow passes over and around the lighting assembly, the airflow may generate turbulence in the form of eddies, vortices, and the like. The turbulence may adversely affect the operating environment. For example, the resulting turbulence may cause components, items, and even anatomical portions of a patient within the operating environment to shift or move and/or cause contaminants to enter the operating environment.

SUMMARY OF THE DISCLOSURE

Certain embodiments of the present disclosure provide an overhead support system configured to be positioned within a room. The system may include a main housing configured to secure a plurality of lighting elements in a manner permitting movement of each of the plurality of lighting elements relative to the main housing. Each of the plurality of lighting elements is configured to move relative to the main housing.

A light control unit is configured to control operation of each of the plurality of lighting elements. The light operation interface is configured to be used to move the plurality of lighting elements relative to the main housing to focus emitted light on a target location within the room. Each of the plurality of lighting elements may include at least one light-emitting diode.

The system may also include a moveable boom connected to the light operation interface. Alternatively, the light operation interface includes a handheld device, such as a remote control.

The system may also include an air delivery sub-system. In at least one embodiment, the main housing may include at least one air delivery panel.

The light operation interface may be configured to allow one or both of a light color or light intensity of the plurality of lighting elements to be adjusted. The light operation interface may include one or more light-focusing direction buttons configured to direct movement of the plurality of lighting elements. In at least one embodiment, the light operation interface includes at least one rotary button configured to direct movement of the plurality of lighting elements. In at least one other embodiment, the light operation interface may include a joystick configured to direct movement of the plurality of lighting elements.

The light operation interface may also or alternatively include a touch screen display showing a representation of a room. The touch screen display is configured to be engaged to direct movement of the plurality of lighting elements within the actual room.

In at least one other embodiment, the light operation interface may include an aiming device configured to direct movement of the plurality of lighting elements.

Alternatively, the light operation interface may include a position detector and a locating device. The position detector is configured to detect a position of the locating device. The control unit is configured to control movement of the plurality of lighting elements based on the detected position of the locating device.

In at least one other embodiment, the light operation interface may include a position and motion detector. The position and motion detector is configured to detect a position and motion of a physiological structure, such as a hand. The control unit is configured to control movement of the plurality of lighting elements based on the detected position and motion of the physiological structure.

Certain embodiments of the present disclosure provide a method of focusing emitted light within a room through an overhead support system that includes a main housing, and a plurality of lighting elements secured to the main housing. Each of the plurality of lighting elements is configured to move relative to the main housing. The method may include controlling operation of each of the plurality of lighting elements with a light control unit, and engaging a light operation interface that is in communication with the light control unit to move the plurality of lighting elements relative to the main housing to focus emitted light on a target location within the room. The method may also include directing airflow through an air delivery sub-system of the overhead support system.

Figure 1:
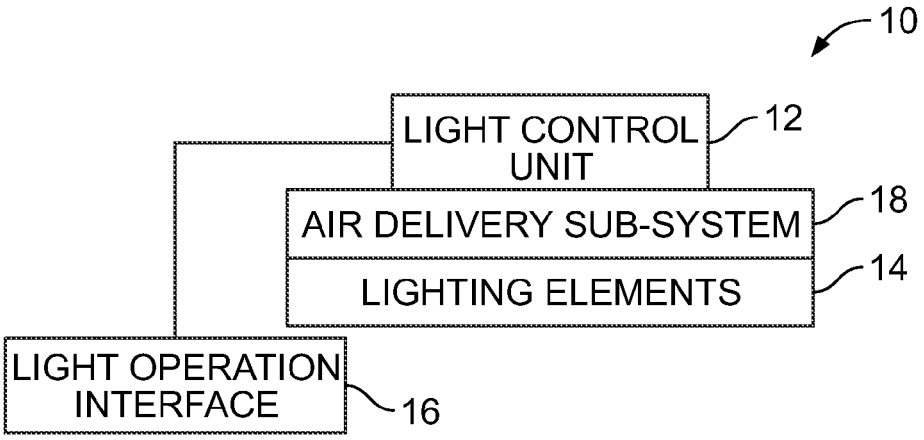
FIG. 1 illustrates a simplified block diagram of an overhead support system, according to an embodiment of the present disclosure.

Before the embodiments are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE DRAWINGS

Embodiments of the present disclosure provide overhead support systems that are configured to be secured to a structure, such as a ceiling, wall, or the like. The overhead support systems may include one or more lighting elements that are operatively connected to one or more light control units. A light operation interface communicates with the light control unit to control operation of the lighting elements. For example, an individual may use the light operation interface to focus the lighting elements at desired target areas within an area, such as an operating room. Instead of moving separate and distinct lighting assemblies connected to articulating booms secured to a ceiling, the lighting elements themselves within a housing or an assembly are actuated through various directions to focus light at desired target areas.

FIG. 1 illustrates a simplified block diagram of an overhead support system 10, according to an embodiment of the present disclosure. The overhead support system 10 may include a light control unit 12 operatively connected to one or more lighting elements 14. The light control unit 12 may be located within a housing that includes the lighting elements 14 and/or an air delivery sub-system 18, or the light control unit 12 may be remotely located from such a housing.

A light operation interface 16 may be operatively connected to and in communication with the light control unit 12. For example, the light operation interface 16 may be connected to the light control unit 12 through wired or wireless connections. In at least one embodiment, the light operation interface 16 may include a moveable boom assembly secured to a ceiling, for example. In at least one other embodiment, the light operation interface 16 may be a remote control or other such device, such as a cellular or smart phone, tablet, other handheld device, computer, monitor, or the like.

The overhead support system 10 may also include an air delivery sub-system 18 configured to deliver air to an environment. Alternatively, the overhead support system 10 may not include the air delivery sub-system 18.

The light control unit 12 controls the lighting elements 14. The light control unit 12 is electrically connected to each of the lighting elements 14, such as through wired or wireless connections. The light control unit 12 may include one or more control units, such as computing and/or processing devices that may include one or more microprocessors, microcontrollers, integrated circuits, memory, such as read-only and/or random access memory, and the like. The light control unit 12 may include any suitable computer-readable media used for data storage. The computer-readable media are configured to store information that may be interpreted by the light control unit 12. The information may be data or may take the form of computer-executable instructions, such as software applications, that cause a microprocessor or other such control unit within the light control unit 12 to perform certain functions and/or computer-implemented methods. The computer-readable media may include computer storage media and communication media. The computer storage media may include volatile and non-volatile media, removable and non-removable media implemented in any method or technology for storage of information such as computer-readable instructions, data structures, program modules or other data. The computer storage media may include, but are not limited to, RAM, ROM, EPROM, EEPROM, flash memory or other solid state memory technology, CD-ROM, DVD, or other optical storage, magnetic cassettes, magnetic tape, magnetic disk storage or other magnetic storage devices, or any other medium which may be used to store desired information and that may be accessed by components of the system.

In operation, an individual controls operation of the lighting elements 14 through the light operation interface 16. As an example, if the lighting elements 14 are to be activated, the individual may engage an activation button or touch screen area of the light operation interface 16 to activate the lighting elements 14. If illumination of a particular target site within a room is desired, the individual may engage the light operation interface 16 to direct and focus light energy at the target site. As the light operation interface 16 is engaged, the light control unit 12 controls the lighting elements 14 based on the received inputs from the light operation interface 16.

Figure 2:
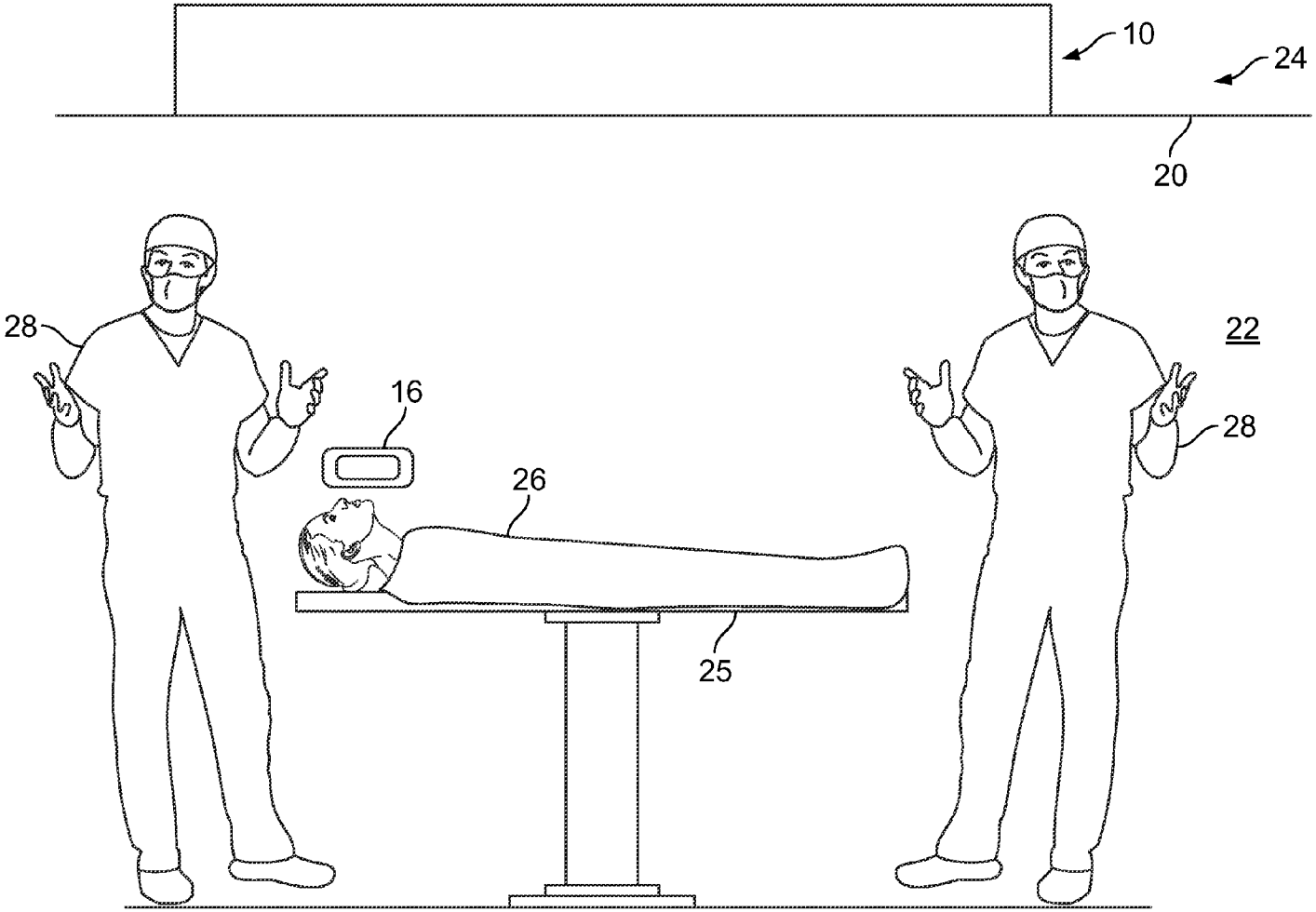
FIG. 2 illustrates a lateral view of an overhead support system secured to a ceiling of an operating room, according to an embodiment of the present disclosure.

FIG. 2 illustrates a lateral view of the overhead support system 10 secured to a ceiling 20 of an operating room 22, according to an embodiment of the present disclosure. The overhead support system 10 may be secured above or below the ceiling 20. For example, the overhead support system 10 may be positioned within a plenum 24 that is above or below the ceiling 20.

The overhead support system 10 is configured to illuminate the operating room 22. Additionally, the overhead support system 10 may be configured to provide air to the operating room 22. Alternatively, the overhead support system 10 may not be configured to deliver air to the operating room 22.

The operating room 22 may include a surgical table 25 configured to support a patient 26. During a surgical operation, a healthcare professional 28 operates on the patient 26. The healthcare professional 28 may engage the light operation interface 16 to focus light at a target site, for example. The light operation interface 16 may be secured to a moveable boom (not shown in FIG. 2) that securely connects to the overhead support system 900 through the ceiling 20. Alternatively, the light operation interface 16 may be a handheld device, such as a remote control. Also, alternatively, the light operation interface 16 may be part of a standalone computer workstation (not shown in FIG. 2) that is in communication with the light control unit 12 (shown in FIG. 1) of the overhead support system 10.

Figure 3:
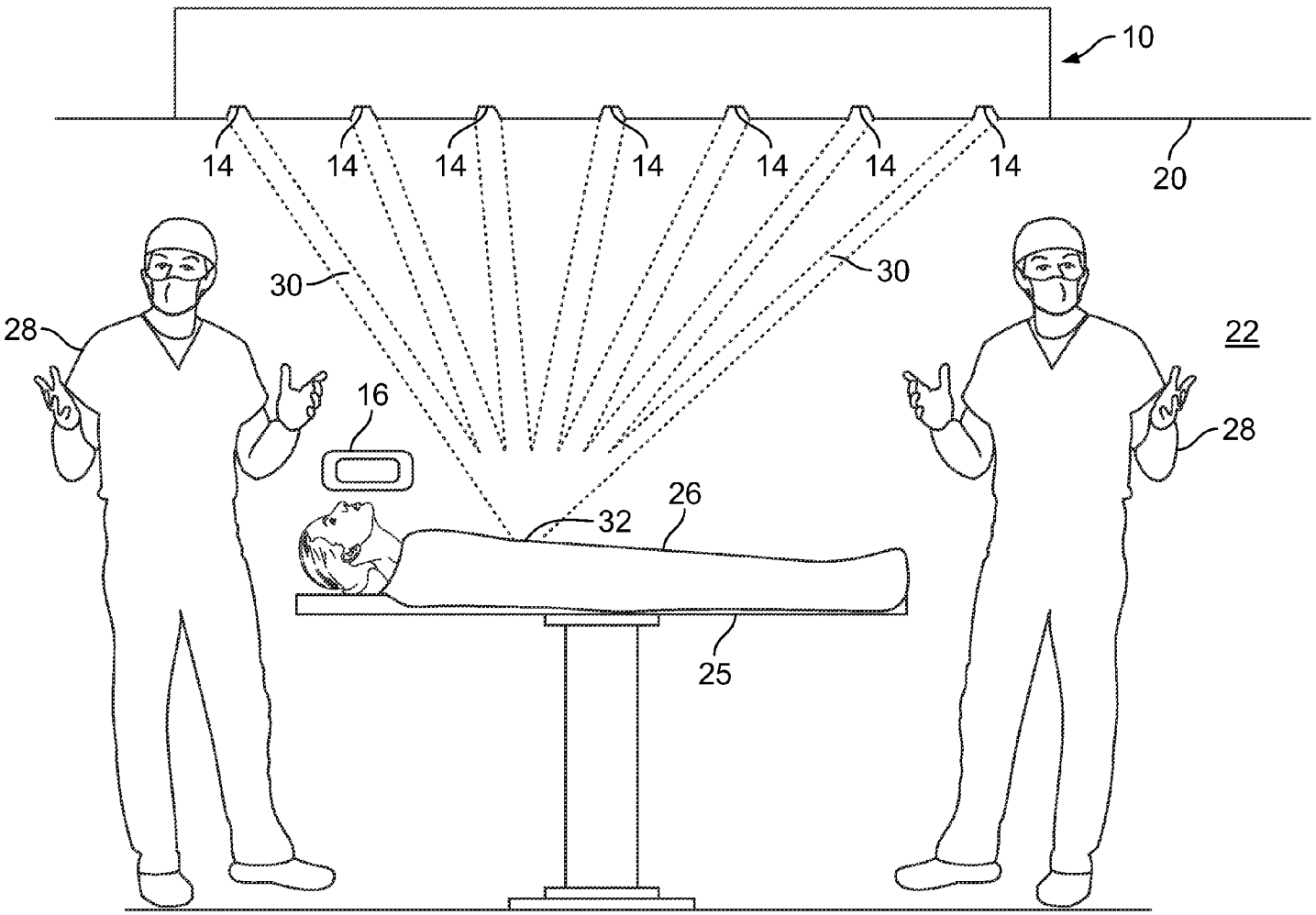
FIG. 3 illustrates a lateral view of an overhead support system secured to a ceiling of an operating room and focusing light at a target location, according to an embodiment of the present disclosure.

FIG. 3 illustrates a lateral view of the overhead support system 10 secured to the ceiling 20 of the operating room 22 and focusing emitted light 30 at a target location 32, according to an embodiment of the present disclosure. The light operation interface 16 has been engaged to direct and focus the light 30 from the lighting elements 14 on the target location 32, which may be a surgical location on the patient 26 and relative to the table 25. As shown, the lighting elements 14 move within and relative to the overhead support system 10 to focus the light 30 at the target location 32. A separate and distinct lighting boom may not be used to direct light to the target location 32. There may be no intervening lighting component between the table 25 and the overhead support system 10 that interferes with airflow therebetween. As such, the overhead support system 10 eliminates, minimizes, or otherwise reduces any air turbulence within the operating room 22. Alternatively, a separate and distinct lighting boom may be used to direct light to the target location 32. For example, a lighting boom in the form of a light-directing pointer may be used to direct light toward the target location 32. An example of such a lighting boom is shown and described with respect to FIG. 13.

Figure 4:
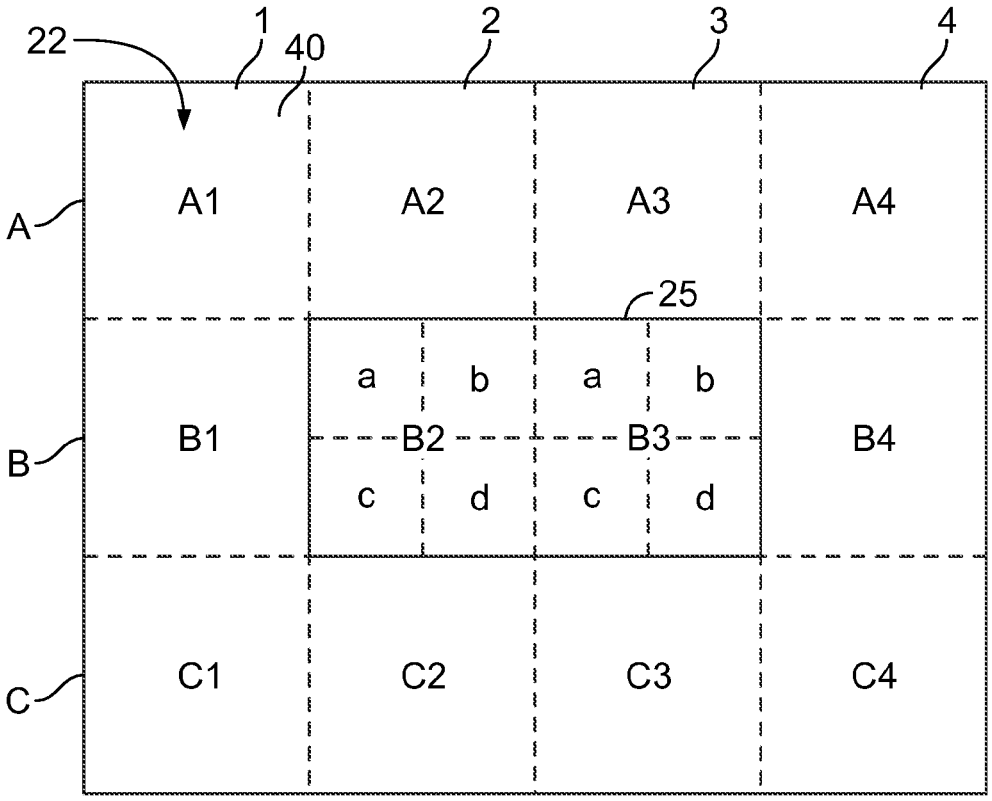
FIG. 4 illustrates a top plan view of an operating room, according to an embodiment of the present disclosure.

FIG. 4 illustrates a top plan view of the operating room 22, according to an embodiment of the present disclosure. Referring to FIGS. 1 and 4, the control unit 12 may divide the operating room 22 into a plurality of distinct areas 40. For example, the control unit 12 may divide the operating room 22 into a distinct areas 40 based on a plurality of rows A, B, and C, and columns 1, 2, 3, and 4 that define a grid. Further, the control unit 12 may sub-divide areas within the operating room 22 that correspond to the position of the operating table 25. As shown in the example of FIG. 4, the operating table 25 corresponds to areas B2 and B3. Each of areas B2 and B3 may be further sub-divided into additional sub-areas, such as sub-areas B2*a*, B2*b*, B2*c*, B2*d*, B3*a*, B3*b*, B3*c*, and B3*d*. While the operating room 22 is shown divided into twelve areas, and the operating table 25 is divided into eight sub-areas, the operating room 22 may be divided and sub-divided into more or less areas than shown. For example, while the operating table 25 is shown sub-divided into eight separate sub-areas, it is to be understood that each of the distinct areas 40 within the operating room 22 may also be sub-divided. As an example, the operating room 22 may be divided into sixty-four areas, each of which is sub-divided into sixty-four sub-areas.

The control unit 12 may be programmed with data related to the size of the operating room 22 and the table 25 in order to generate the areas 40 shown. The control unit 12 correlates the areas 40 and sub-areas in relation to movement of the lighting elements 14. For example, the light operation interface 16 may be engaged to select area B2*a*. The control unit 12 receives the input from the light operation interface 16 and moves the lighting elements 14 so that they focus emitted light on the area B2*a* within the operating room 22. The control unit 12 may move all of the lighting elements 14 to the selected area. Alternatively, sub-sets of the lighting elements 14 may be moved so that emitted light focuses on one target area, while other sub-sets of the lighting elements 14 are not moved, or are moved so that emitted light focuses on another target area.

Figure 5:
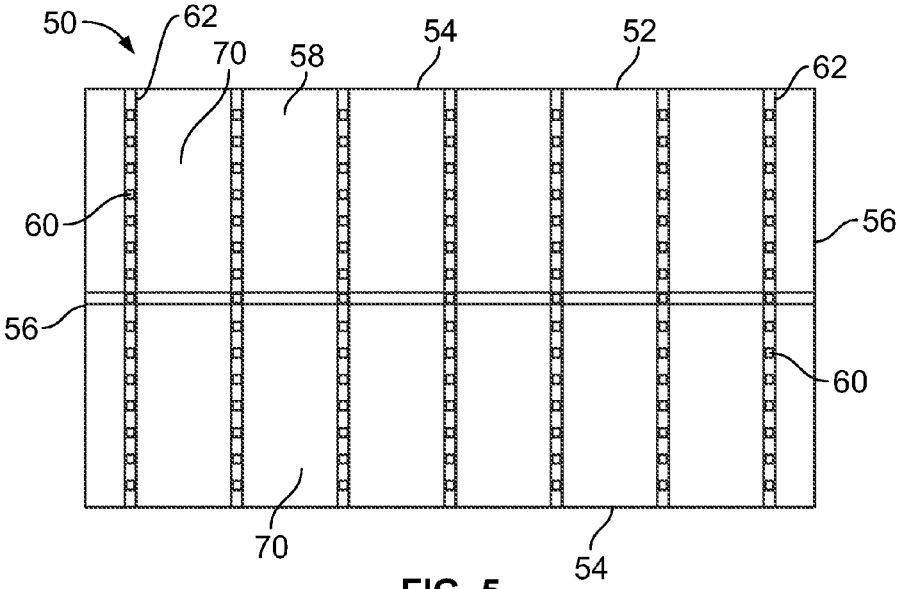
FIG. 5 illustrates a bottom view of an overhead support system, according to an embodiment of the present disclosure.

FIG. 5 illustrates a bottom view of an overhead support system 50, according to an embodiment of the present disclosure. The overhead support system 50 is an example of the overhead support system 10, shown in FIGS. 1-3. The overhead support system 50 includes a main housing 52 having opposed lateral walls 54 connected to opposed end walls 56. A bottom surface 58 connects proximate to bottom edges of the lateral walls 54 and the end walls 56. A plurality of lighting elements 60 are exposed through the bottom surface 58. The lighting elements 60 may be arranged in linear columns 62, for example. As shown in FIG. 5, each column 62 may include fifteen lighting elements 60, although each column 62 may include more or less lighting elements 60.

Alternatively, the lighting elements 60 may be arranged in various other orientations. For example, the lighting elements 60 may be arranged to form concentric circles or other shapes on the overhead support system 50.

Air delivery panels 70 may be disposed between the columns 62 of the lighting elements 60. The air delivery panels 70 may include air nozzles, outlets, or the like configured to allow air to pass therethrough. Alternatively, the overhead support system 50 may not include the air delivery panels 70.

Referring to FIGS. 1 and 5, the light control unit 12 may group the lighting elements 60 into various groups or sub-sets. For example, the light control unit 12 may group the lighting elements 60 two or more rows and/or two or more columns. As an example, the light control unit 12 may divide the lighting elements 60 into groups, sets, sub-sets, and/or sub-groups that correspond to the areas of the operating room 22, as shown in FIG. 4. In doing so, the control unit 12 allows an individual to select a particular portion of lighting elements 60 for movement. For example, the individual may engage the light operation interface to select a corner sub-set of lighting elements 60 to focus on the area B2*c* of the operating room 22, while another corner sub-set of the lighting elements 60 focuses on the area B3*b* of the operating room 22.

As shown in FIG. 5, the lighting elements 60 are configured to be moved relative to the main housing 52. The lighting elements 60 are secured to the main housing 52, but include portions that move in relation to the main housing 52 so that emitted light may be directed and focused at various locations within a room. When the direction and focus of the emitted light is moved, the main housing 52 remains fixed and stationary, but the lighting elements 60 themselves move in relation to the main housing 52 in order to change the direction and focus of emitted light. Embodiments of the present disclosure are unlike prior light boom assemblies with fixed lighting elements, in which the entire light boom assemblies were moved to direct and focus light at different locations.

Figure 6:
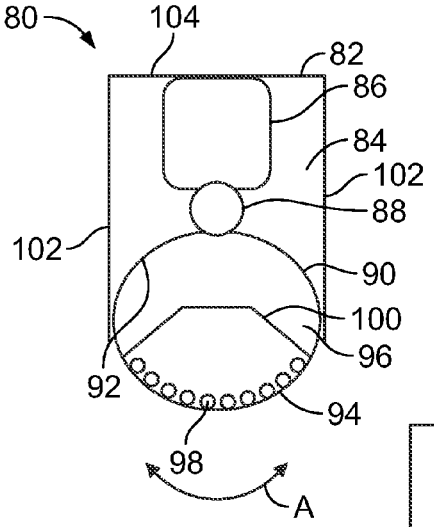
FIG. 6 illustrates a simplified view of a lighting element, according to an embodiment of the present disclosure.

FIG. 6 illustrates a simplified view of a lighting element 80, according to an embodiment of the present disclosure. The lighting element 80 is an example of any of the lighting elements discussed above. The lighting element 80 may include a support bracket 82 configured to secure the lighting element 80 into an overhead support system. For example, the support bracket 82 may be configured to snapably secure the lighting element 80 into a reciprocal channel formed in a bottom surface of the overhead support system.

The bracket 82 defines an internal space 84 into which an actuator 86 is secured. For example, the actuator 86 may be securely fastened to a portion of the bracket 82. The actuator 86 is operatively connected to a moveable link 88, such as a gear, spherical member, and/or the like, which, in turn, is operatively connected to a light pod 90. The light pod 90 may include a link contact surface 92 that operatively connects to the link 88. The link contact surface 92 connects to a transparent cover 94. An internal chamber 96 is defined between the link contact surface 92 and the transparent cover 94. A plurality of light emitters 98 are secured within the internal chamber 96 and are configured to emit light through the transparent cover 94. Each light emitter 98 may be a light-emitting diode (LED), incandescent light bulb, fluorescent light bulb, or the like. A reflector 100 may be positioned behind the light emitters 98 and configured to reflect light emitted from the light emitters 98 through the transparent cover 94.

The actuator 86 may be a servo motor, for example. The actuator 86 may be a rotary actuator that allows for precise control of angular position, velocity, and acceleration. The actuator 86 may include a motor that couples to a sensor for position feedback. Each actuator 86 is operatively connected to and/or in communication with the light control unit 12 (shown in FIG. 1).

In operation, the actuator 86 engages the link 88 to move the light pod 90 through various directions. As shown in FIG. 6, the actuator 86 may move the light pod 90 in the directions of arcs A, which are relative to sides 102 of the bracket 82, and in directions toward and away from a base 104 of the bracket 82.

Figure 7:
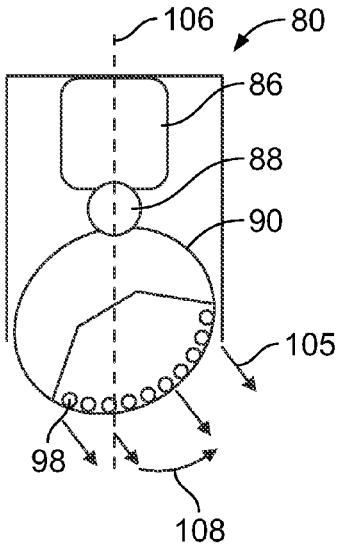
FIG. 7 illustrates a simplified view of a light pod of a lighting element moved in a first direction, according to an embodiment of the present disclosure.

FIG. 7 illustrates a simplified view of the light pod 90 of the lighting element 80 moved in a first direction, according to an embodiment of the present disclosure. The light pod 90 has been moved by the actuator 86 so that light 105 emitted from the light emitters 98 is directed toward a first side 108 of a central axis 106 of the lighting element 80.

Figure 8:
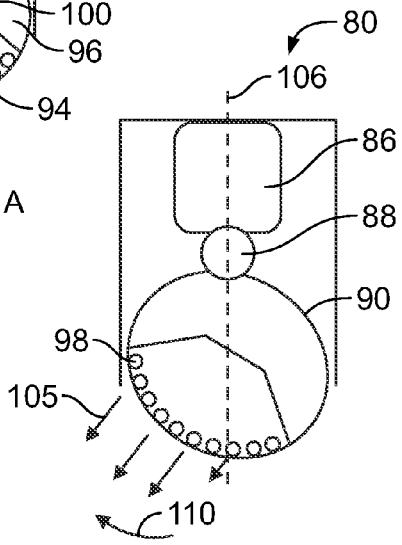
FIG. 8 illustrates a simplified view of a light pod of a lighting element moved in a second direction, according to an embodiment of the present disclosure.

FIG. 8 illustrates a simplified view of the light pod 90 of the lighting element 80 moved in a second direction, according to an embodiment of the present disclosure. The light pod 90 has been moved by the actuator 86 so that light 105 emitted from the light emitters 98 is directed toward a second side 110 of the central axis 106 of the lighting element 80.

Referring to FIGS. 1 and 6-8, the actuator 86 is configured to move the light pod 90 so that the light emitters 98 emit light at varying angles, based on input received by the light control unit 12 from the light operation interface 16. The light pod 90 may be actuated through radial sweeps, lateral pivots, longitudinal pivots, diagonal pivots, and the like. The lighting element 80 shown in FIGS. 6-8 is merely an example. Various other lighting elements 80 that are configured to be moved through various directions may be used.

Figure 9:
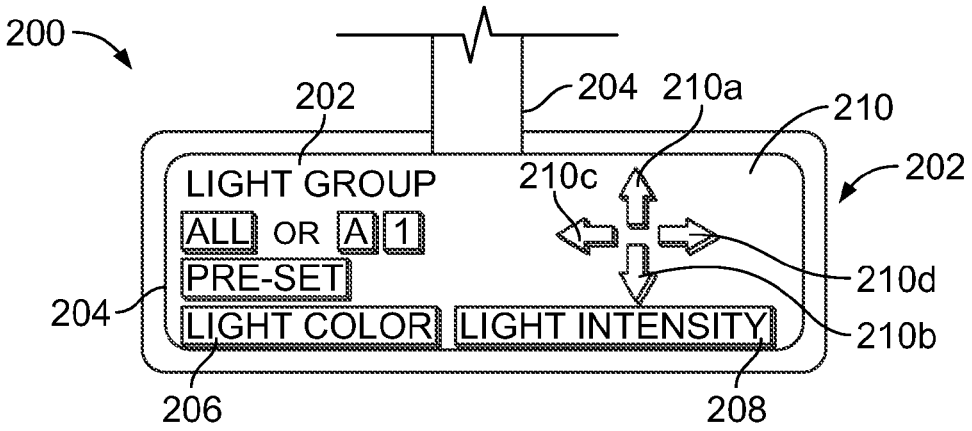
FIG. 9 illustrates a front view of a light operation interface, according to an embodiment of the present disclosure.

FIG. 9 illustrates a front view of a light operation interface 200, according to an embodiment of the present disclosure. The light operation interface 200 is an example of the light operation interface 16 (shown in FIG. 1). The light operation interface 200 may include a display 202 that may be secured to a moveable boom 204. Alternatively, the light operation interface 200 may not be connected to the boom 204, but instead may be a remote control, handheld device, computer monitor, or the like that is in communication with the light control unit 12 (shown in FIG. 1).

The light operation interface 200 may include a group selection area 202, a pre-set area 205, a light color button 206, a light intensity button 208, and light-focusing direction buttons 210. Each of the area or buttons on the light operation interface 200 may be part of a touch screen surface and/or physical tactile areas or buttons.

Referring to FIGS. 1 and 9, in operation, an individual may select a group of lighting elements 14 to be moved so that emitted light is directed to a desired target area within a room. The individual may select all of the lights through the group selection area 202, or a sub-set of lights, such as sub-set A1, which may correspond to a pre-programmed sub-set of lights. The individual may then move the lights through the light-focusing direction buttons 210. As shown in FIG. 9, the light-focusing direction buttons 210 includes an up arrow 210*a*, a down arrow 210*b*, a left arrow 210*c*, and a right arrow 210*d*. The individual may move the light elements 14 through the directions buttons 210.

If the individual does not specifically select light elements through the group selection area 202, the control unit 12 may activate all of the light elements 14 through a default setting. Optionally, the light control unit 12 may send a signal to the light operation interface 200 to generate an audio or visual signal to alert the individual to select one or more lighting elements 14.

The pre-set area 205 may be used to toggle through and/or display multiple lighting pre-sets. For example, various lighting element configurations may be pre-set, such as certain lighting elements being focused on portions of an operating table, certain lighting elements being focused towards an exit of the operating room, and/or the like. Additionally, an individual may program various lighting settings related to pre-operation, post-operation, room clean-up, and/or the like. Thus, the pre-set area 205 allows an individual to select among multiple pre-programmed lighting configurations, which may be based on various lighting scenes or settings.

The light color button 206 may be used to toggle through and/or display the color of light emitted from the light elements 14. For example, if the light elements 14 include LEDs, the LEDs may be switched between various emitted colors. In at least one embodiment, the light elements 14 may be switched from white light to a filtered light, such as a 550 nanometer green light, which has been found to be useful during surgery, as that wavelength of light helps to clearly define a surgical area and reduce eye fatigue. However, the light elements may be selectively switched among various other wavelengths, as well.

Additionally, the light intensity button 208 may be engaged to toggle through and/or display various light intensity options. For example, an individual may prefer to change the intensity of light during a surgical procedure.

Figure 10:
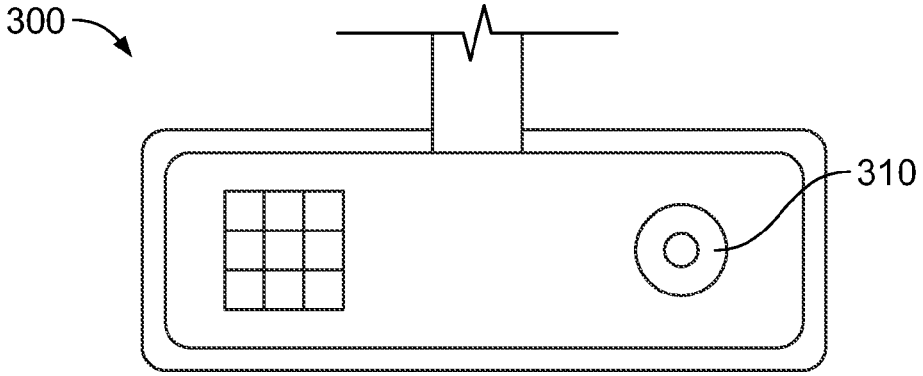
FIG. 10 illustrates a front view of a light operation interface, according to an embodiment of the present disclosure.

FIG. 10 illustrates a front view of a light operation interface 300, according to an embodiment of the present disclosure. The light operation interface 300 is an example of the light operation interface 16 (shown in FIG. 1). The light operation interface 300 may be similar to the light operation interface 200 (shown in FIG. 9), except that, instead of arrows, the light operation interface 300 includes a rotary button 310, which may be part of a touch screen surface or a rocker or rotating button, which may be engaged to move the lighting elements.

Figure 11:
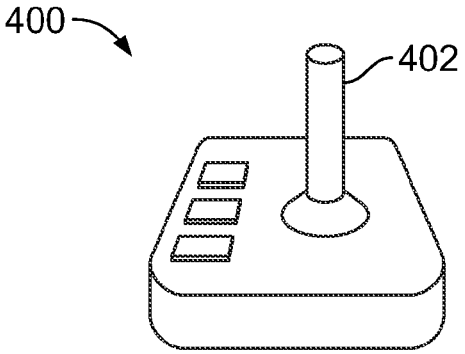
FIG. 11 illustrates an isometric top view of a light operation interface, according to an embodiment of the present disclosure.

FIG. 11 illustrates an isometric top view of a light operation interface 400, according to an embodiment of the present disclosure. The light operation interface 400 is an example of the light operation interface 16 (shown in FIG. 1). The light operation interface 400 may be similar to the light operation interface 200 (shown in FIG. 9), except that, instead a touch screen or arrow buttons, the light operation interface 400 may include a joystick 402 that is used to control movement of the lighting elements.

Figure 12:
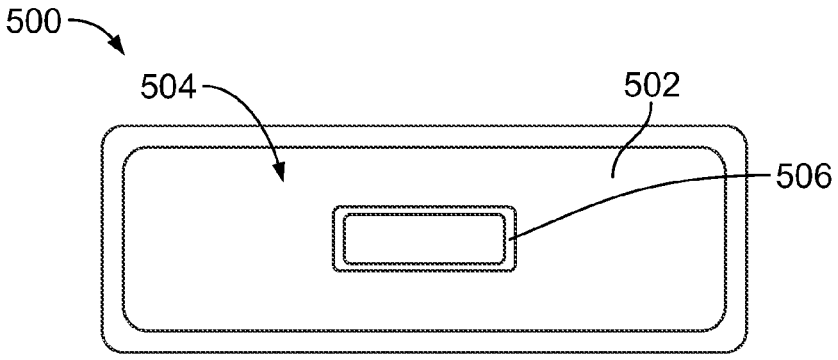
FIG. 12 illustrates a front view of a light operation interface, according to an embodiment of the present disclosure.

FIG. 12 illustrates a front view of a light operation interface 500, according to an embodiment of the present disclosure. The light operation interface 500 is an example of the light operation interface 16 (shown in FIG. 1). The light operation interface 500 may be similar to the light operation interface 200 (shown in FIG. 9), except that the light operation interface 500 includes a touch screen 502 that shows an operating room representation 504 and an operating table representation 506. An individual may activate movement of the lighting elements, such as by double tapping the touch screen 502, and then moving the light elements by sliding a finger to a desired target area on the touch screen 502. Because the operating room representation 504 and the operating table representation 506 are correlated with the space of the actual operating room and actual operating table, lighting element movement may be controlled through engagement with the touch screen 502 to direct and focus emitted light from the lighting elements onto a desired target area.

Alternatively, a map of the operating room and table may be shown on the light operation interface 500 within specific areas and sub-areas within the operating room shown. The individual may then input a specific area or sub-area where light is to be directed and focused. For example, the individual may input the desired area or sub-area through a keyboard, a mouse, voice control, and/or the like.

Figure 13:
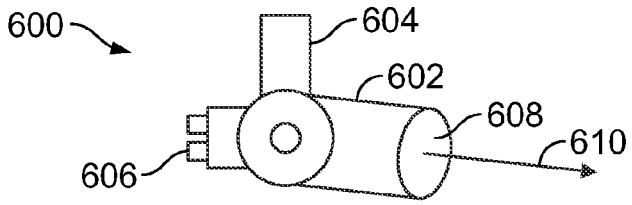
FIG. 13 illustrates a lateral view of a light operation interface, according to an embodiment of the present disclosure.

FIG. 13 illustrates a lateral view of a light operation interface 600, according to an embodiment of the present disclosure. The light operation interface 600 is an example of the light operation interface 16 (shown in FIG. 1). The light operation interface 600 may include an aiming device 602, such as a tube, barrel, wand, beam, or the like, operatively connected to a moveable boom 604. Alternatively, the aiming device 602 may not be connected to the boom 604. The light operation interface 600 may include an interface 606 including buttons and areas, such as any of those described above.

The aiming device 602 may be in communication with the light control unit 12 (shown in FIG. 1). Movement of the aiming device 602 may be correlated with movement of the lighting elements 14 within the room. For example, as the aiming device 602 is activated and moves to the left or right, the light control unit 12 may move the lighting elements 14 in response thereto. The aiming device 602 may also include a marker light 608, such as a laser, that emits a marker 610 that allows an individual to see exactly where the aiming device 602 is being aimed.

Figure 14:
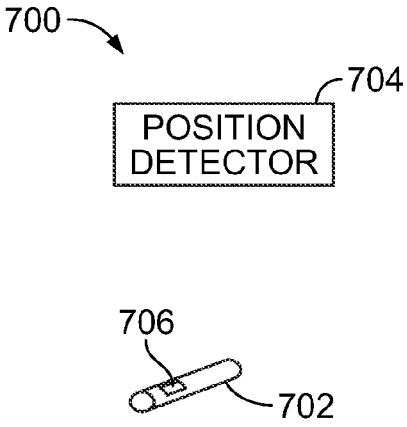
FIG. 14 illustrates a schematic diagram of a light operation interface, according to an embodiment of the present disclosure.

FIG. 14 illustrates a schematic diagram of a light operation interface 700, according to an embodiment of the present disclosure. The light operation interface 700 is an example of the light operation interface 16 (shown in FIG. 1). The light operation interface 700 may include a locating device 702, such as a wand, token, or the like, and a position detector 704. The position detector 704 is configured to track the location of the locating device 702. For example, the locating device 702 may include a radio-frequency (RF) chip that is tracked by an RF sensor within the position detector 704. Alternatively, the position detector 704 may track movement of the locating device 702 through various other tracking systems and methods, such as infrared or heat tracking systems and methods.

In order to move the lighting elements 14 (shown in FIG. 1), the locating device 702 may be activated for tracking, such as through a button 706 on the locating device 702 being depressed. When activated for tracking, the position detector 704 tracks the movement of the locating device 702. The control unit 12 (shown in FIG. 1) receives the movement signals from the position detector 704 and moves the lighting elements 14 according the tracked movement of the locating device 702. Once the individual is satisfied with the target location for focused light, the button 706 may be depressed to deactivate the movement of the lighting elements 14.

Figure 15:
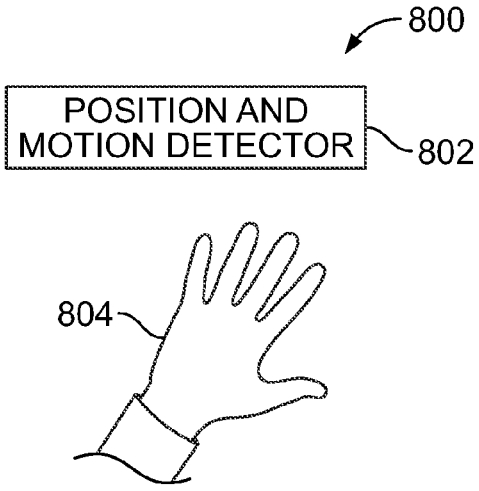
FIG. 15 illustrates a schematic diagram of a light operation interface, according to an embodiment of the present disclosure.

FIG. 15 illustrates a schematic diagram of a light operation interface 800, according to an embodiment of the present disclosure. The light operation interface 800 is an example of the light operation interface 16 (shown in FIG. 1). The light operation interface 800 may be similar to the light operation interface 700 (shown in FIG. 14), except that, instead a separate and distinct locating device, the light operation interface 800 may include a position and motion detector 802 configured to recognize and track movements of a hand 804 of an individual. The position and motion detector 802 may include a video camera configured to detect movement and position of the hand 804. The light control unit 12 (shown in FIG. 1) may be programmed to recognize various hand gestures a light movement operations. For example, the position and motion detector 802 and/or the light control unit 12 may be programmed to detect a particular hand gesture as an activation and deactivation. Once activated, the position and motion detector 802 may track movement of the hand 804, and the light control unit 12 (shown in FIG. 1) may move the lighting elements 14 (shown in FIG. 1) in relation to movement of the hand 804. In this way, the emitted light from the lighting elements 14 may be directed and focused on specific target locations based on body movements of an individual.

Figure 16:
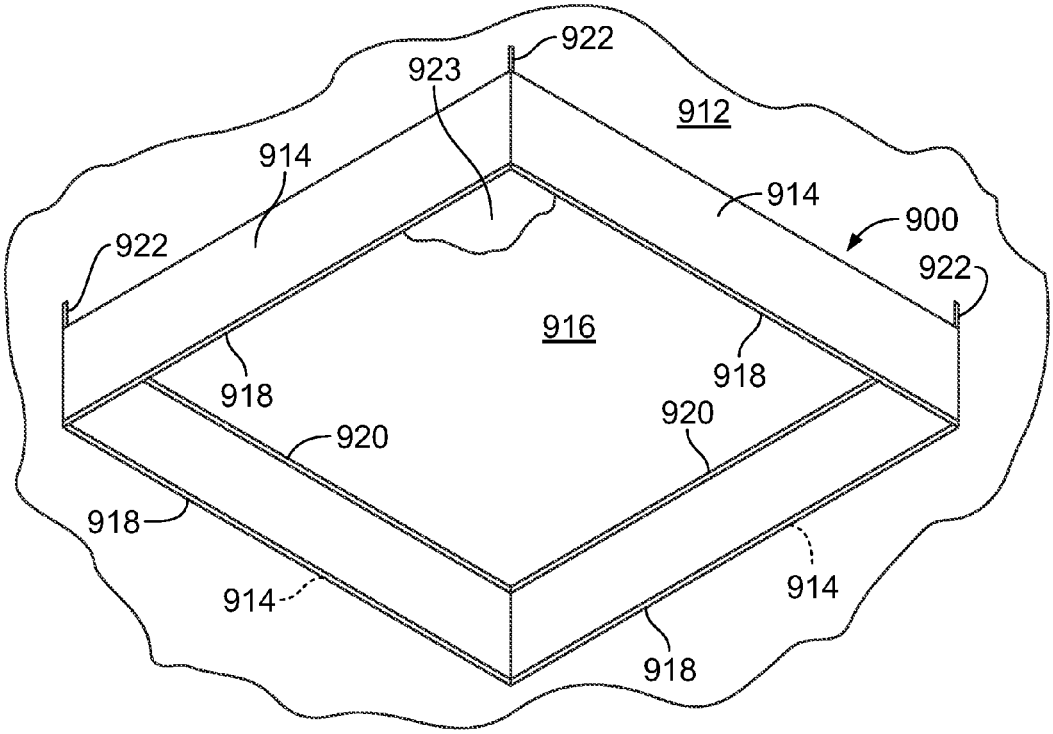
FIG. 16 illustrates an isometric bottom view of an overhead support system, according to an embodiment of the present disclosure.

FIG. 16 illustrates an isometric bottom view of an overhead support system 900, according to an embodiment of the present disclosure. The overhead support system 900 may be a plenum box module, or other such system that is configured to modularly secure to a ceiling 912 of a structure. The overhead support system 900 may be configured to support an air handling unit, sprinkler systems, lighting systems, equipment, and the like. The support system 900 may be further described in U.S. Patent Application Publication No. 2011/0097986, entitled "Ceiling System With Integrated Equipment Support Structure," which is hereby incorporated by reference in its entirety. The overhead support system 900 is configured to be secured to a ceiling of an enclosed structure, such as clean room. As such, the overhead support system 900 is configured to be positioned over individuals within the enclosed structure. The overhead support system 900 defines an internal air delivery chamber that may be in fluid communication with an air delivery system, such as an air handling unit. Conditioned air from the air handling unit is passed to the air delivery chamber, and into the enclosed structure through one or more air delivery outlets formed in the overhead support system 900. Thus, the overhead support system 900 may be configured to deliver conditioned air to the enclosed structure. For the sake of clarity, a light control unit, lighting elements, and a light operation interface are not shown in FIG. 16.

The overhead support system 900 may form a housing or plenum that includes outer walls 914 that define an internal chamber 916. The outer walls 914 may connect together at right angles, and form a generally square or rectangular structure, as shown. However, the outer walls 914 may be various other shapes and sizes, such as circular, elliptical, triangular, trapezoidal, or the like.

The outer walls 914 may be formed of metal, such as sheet steel, for example. However, the outer walls 914 may be formed of various other materials, such as reinforced plastic. In general, the outer walls 914 may be configured to accommodate heating and cooling needs of the structure, as well as to securely attach to the ceiling 912. Each of the outer walls 914 may include a lower lip 918 and a support beam 920, which may be located at upper portions of the outer walls 914. The upper support beam 920 may be formed as a rectangular member, such as a rectangular beam, tube, or the like.

While not shown in FIG. 16, grid members may be attached to the lower lip 918, and form a grid of supports for the ordinary parts of a suspended ceiling, such as ceiling tiles, panel assemblies, lights, and vents for air passage (not shown). Alternatively, grid members may be attached to other portions of the outer walls 914. The grid members may be formed as rectangular tubes or U-shaped channels of stainless steel, or extruded aluminum, but may be constructed of other materials and in other shapes as well. The grid members are rigid in order to span the overhead support system 900 without additional support. The grid members may also be attached to the building structure, for instance by the use of hangers, for greater load-bearing capacity. Alternatively, the overhead support system 900 may not include grid members, but may, instead, simply include the outer walls 914, as shown.

A clean room barrier 923 may form a suspended ceiling and extend from the outer walls 914 proximate to the lower lip 918 of the overhead support system 900. In order to clearly show the structure of the overhead support system 900, only a portion of the clean room barrier 923 is shown in FIG. 16. The clean room barrier 923 separates the internal chamber 916 from a clean room into which the overhead support system 900 is secured. The clean room barrier 923 may include a plurality of lighting elements exposed therethrough as explained above. The internal chamber 916 may provide an air delivery chamber that is configured to convey air, such as air conditioned by an air handling system, to the internal space of the clean room. For example, the internal chamber 916 may be in communication with an output of an air handling unit that is configured to provide conditioned air to the clean room. An air outlet may be secured to or formed through a portion of the clean room barrier 923 to allow conditioned air to pass from the overhead support system 900 into the clean room.

The overhead support system 900 may be sealed at the top by a sealing wall or roof in order to control airflow. The sealing wall or roof may be formed of sheet metal, plastic, or the like. A hole may be formed in the sealing wall and/or the outer walls 914 to permit air to enter or leave the overhead support system 900, and therefore the room. An air handling component (not shown) may be mounted adjacent the hole(s), or may be operatively connected to a duct (not shown) that connects to the hole(s). Alternatively, the overhead support system 900 may have an air handling component mounted directly thereto. The overhead support system 900 may receive supply air from various types of HVAC and air handling systems.

The overhead support system 900 may be suspended from the ceiling 912 by hangers 922, which may in turn attach directly to I-beams or other frame members of the building. The hangers 922 may also be attached to a secondary structure (not shown) which in turn attaches to the frame of the building. Alternatively, the overhead support system 900 may also be bolted directly to part of the building or an adapter rather than suspended from hangers 922. As shown in FIG. 16, the hangers 922 may be at the corners of overhead support system 900, but may be placed in other locations, or with greater spatial frequency than shown.

Referring to FIGS. 1 and 16, the overhead support system 900 provides examples of additional structural features of the overheard support assembly 10, according to at least one embodiment of the present disclosure. For example, the light control unit 12, the lighting elements 14, and the air delivery sub-system 18 may be secured within the internal chamber 916 between the outer walls 914 and the clean room barrier 923. The lighting elements 14 may be secured within the internal chamber 916 such that light-emitting members are exposed through the clean room barrier 923, while the clean room barrier 923 may also include air delivery panels (such as the air delivery panels 70 shown and described with respect to FIG. 5) having air outlet members, such as nozzles, openings, or the like, formed therethrough. The overhead support system 10 may be part of a module or assembly suspended from the ceiling 912. The overhead support system 10 may be further supported by grid members, as discussed above, and/or as described in U.S. Pat. No. 5,794,397, entitled "Clean Room Ceiling Structure Light Fixture Wireway," which is hereby incorporated by reference in its entirety.

Embodiments of the present application may be used with air handling systems and fan arrays. Air handling systems and fan arrays are further described and shown, for example, in U.S. Pat. No. 7,527,468, entitled "Fan Array Fan Section In Air-Handling Systems," U.S. Pat. No. 7,922,442, entitled "Fan Array Fan Section In Air Handling Systems," U.S. Pat. No. 7,914,252, entitled "Fan Array Fan Section In Air Handling Systems," U.S. Pat. No. 7,597,534, entitled "Fan Array Fan Section In Air Handling Systems," U.S. Pat. No. 8,087,877, entitled "Fan Array Fan Section In Air Handling Systems," U.S. Patent Application Publication No. 2011/0014061, entitled "Fan Array Control System," and U.S. Patent Application No. 2011/0255704, entitled "Methods and Systems for Active Sound Attenuation In An Air Handling Unit," all of which are hereby incorporated by reference in their entireties. Embodiments of the present disclosure may be used with various air handling or processing systems.

Embodiments of the present disclosure may be used with respect to an operating and/or clean room. Alternatively, embodiments of the present disclosure may be used in various other rooms and settings. For example, the overhead support systems described above may be used with respect to data centers, such as shown and described in United States Patent Application Publication No. 2010/0051563, entitled "Modular Data Center," which is hereby incorporated by reference in its entirety.

Embodiments of the present disclosure may include, or be used with, air filter assemblies, such as described in U.S. patent application Ser. No. 13/717,826, filed Dec. 18, 2012, entitled "Air Filter Assembly," which is hereby incorporated by reference in its entirety.

Further, embodiments of the present disclosure may be used with respect to equipment boom assemblies, such as described in U.S. patent application Ser. No. 13/737,197, filed Jan. 9, 2013, entitled "Adjustable Equipment Mount Assembly for an Overhead Support Module," and U.S. patent application Ser. No. 13/682,339, filed Nov. 20, 2012, entitled "System and Method for Delivering Air Through a Boom Assembly," both of which are hereby incorporated by reference in their entireties.

Figure 17:
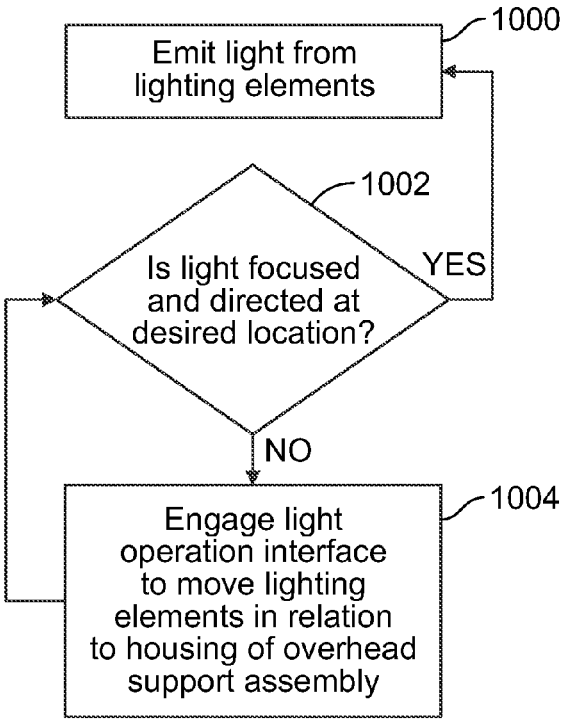
FIG. 17 illustrates a flow chart of a method of operating an overhead support system, according to an embodiment of the present disclosure.

FIG. 17 illustrates a flow chart of a method of operating an overhead support system, according to an embodiment of the present disclosure. At 1000, light is emitted from lighting elements of an overhead support system, such as any of those described above. At 1002, an individual determines whether light is focused and directed at a desired location. If so, the method returns to 1000. If, however, the emitted light is not directed and focused as a desired location, the process continues to 1004, in which a light operation interface is engaged to move the lighting elements in relation to a housing of the overhead support system. The method then returns to 1002.

As described above, embodiments of the present disclosure provide overhead support systems that are configured to be secured to a structure, such as a ceiling, wall, overhead module, or the like. Instead of physically moving separate and distinct lighting assemblies having fixed lights connected to articulating booms secured to a ceiling, embodiments of the present disclosure provide systems and assemblies in which the lighting elements themselves are actuated through various directions to focus light at desired target areas. As such, separate and distinct lighting assemblies do not get in the way of air delivery. Embodiments of the present disclosure minimize or otherwise reduce air turbulence within a room.

Various embodiments described herein provide a tangible and non-transitory (for example, not an electric signal) machine-readable medium or media having instructions recorded thereon for a processor or computer to operate a system to perform one or more embodiments of methods described herein. The medium or media may be any type of CD-ROM, DVD, floppy disk, hard disk, optical disk, flash RAM drive, or other type of computer-readable medium or a combination thereof.

The various embodiments and/or components, for example, the control units, modules, or components and controllers therein, also may be implemented as part of one or more computers or processors. The computer or processor may include a computing device, an input device, a display unit and an interface, for example, for accessing the Internet. The computer or processor may include a microprocessor. The microprocessor may be connected to a communication bus. The computer or processor may also include a memory. The memory may include Random Access Memory (RAM) and Read Only Memory (ROM). The computer or processor may also include a storage device, which may be a hard disk drive or a removable storage drive such as a floppy disk drive, optical disk drive, and the like. The storage device may also be other similar means for loading computer programs or other instructions into the computer or processor.

As used herein, the term "computer," "control unit," or "module" may include any processor-based or microprocessor-based system including systems using microcontrollers, reduced instruction set computers (RISC), application specific integrated circuits (ASICs), logic circuits, and any other circuit or processor capable of executing the functions described herein. The above examples are exemplary only, and are thus not intended to limit in any way the definition and/or meaning of the term "computer," "control unit," or "module."

The computer or processor executes a set of instructions that are stored in one or more storage elements, in order to process data. The storage elements may also store data or other information as desired or needed. The storage element may be in the form of an information source or a physical memory element within a processing machine.

The set of instructions may include various commands that instruct the computer or processor as a processing machine to perform specific operations such as the methods and processes of the various embodiments of the subject matter described herein. The set of instructions may be in the form of a software program. The software may be in various forms such as system software or application software. Further, the software may be in the form of a collection of separate programs or modules, a program module within a larger program or a portion of a program module. The software also may include modular programming in the form of object-oriented programming. The processing of input data by the processing machine may be in response to user commands, or in response to results of previous processing, or in response to a request made by another processing machine.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. An overhead support system configured to be positioned within a room, the system comprising:

a main housing comprising at least a portion of an air-delivery sub-system that is configured to deliver air to the room, the main housing configured to secure a plurality of lighting elements at least partially within the main housing in a manner permitting movement of each of the plurality of lighting elements relative to the main housing, the main housing including a plurality of linear columns arranged in parallel to one another, each linear column formed at least partially by two or more lighting elements of the plurality of lighting elements, wherein an air delivery panel is disposed between each adjacent pair of linear columns and configured to allow air to pass therethrough;

a light control unit configured to be in communication with each of the plurality of lighting elements, wherein the light control unit is configured to control operation of each of the plurality of lighting elements; and a light operation interface in communication with the light control unit, wherein the light operation interface is configured to send inputs to the light control unit, the light control unit controls operation of each of the plurality of lighting elements based on the inputs, and the controlled operation includes moving the plurality of lighting elements relative to the main housing to focus emitted light on a target location within the room.

2. The system of claim 1, further comprising a moveable boom connected to the light operation interface.

3. The system of claim 1, wherein the light operation interface comprises a handheld device.

4. The system of claim 1, wherein the main housing is configured to be suspended from a ceiling of the room.

5. The system of claim 1, wherein each of the plurality of lighting elements comprises at least one light-emitting diode.

6. The system of claim 1, wherein the light operation interface is configured to allow one or both of a light color or light intensity of the plurality of lighting elements to be adjusted.

7. The system of claim 1, wherein the light operation interface comprises one or more light-focusing direction buttons configured to direct movement of the plurality of lighting elements.

8. The system of claim 1, wherein the light operation interface comprises at least one rotary button configured to direct movement of the plurality of lighting elements.

9. The system of claim 1, wherein the light operation interface comprises a joystick configured to direct movement of the plurality of lighting elements.

10. The system of claim 1, wherein the light operation interface comprises a touch screen display showing a representation of a room, and wherein the touch screen display is configured to be engaged to direct movement of the plurality of lighting elements within the room.

11. The system of claim 1, wherein the light operation interface comprises an aiming device configured to direct movement of the plurality of lighting elements.

12. The system of claim 1, wherein the light operation interface comprises a position detector and a locating device, wherein the position detector is configured to detect a position of the locating device, and wherein the light control unit is configured to control movement of the plurality of lighting elements based on the detected position of the locating device.

13. The system of claim 1, wherein the light operation interface comprises a position and motion detector, wherein the position and motion detector is configured to detect a position and motion of a physiological structure, and wherein the light control unit is configured to control movement of the plurality of lighting elements based on the detected position and motion of the physiological structure.

14. A method of focusing emitted light within a room through an overhead support system, the method comprising:

providing an overhead support system including a main housing that contains at least a portion of an air delivery sub system and a plurality of lighting elements secured to the main housing, each of the plurality of lighting elements at least partially contained within the main housing and configured to move relative to the main housing, the main housing including a plurality of linear columns arranged in parallel to one another, each linear column formed at least partially by two or more lighting elements of the plurality of lighting elements;

directing airflow through one or more air delivery panels of the air delivery sub-system of the overhead support system, each of the one or more air delivery panels disposed between an adjacent pair of linear columns;

controlling operation of each of the plurality of lighting elements with a light control unit; and engaging a light operation interface that is in communication with the light control unit to send inputs to the light control unit, wherein the light control unit controls operation of each of the plurality of lighting elements based on the inputs, and the controlled operation includes moving the plurality of lighting elements relative to the main housing to focus emitted light on a target location within the room.

15. The method of claim 14, further comprising suspending the main housing from a ceiling of the room.

16. The method of claim 14, further comprising adjusting a light color or light intensity of the plurality of lighting elements through the light operation interface.

17. The method of claim 14, wherein the engaging a light operation interface comprises engaging one or more light-focusing direction buttons to direct movement of the plurality of lighting elements.

18. The method of claim 14, wherein the engaging a light operation interface comprises engaging at least one rotary button to direct movement of the plurality of lighting elements.

19. The method of claim 14, wherein the engaging a light operation interface comprises engaging a joystick to direct movement of the plurality of lighting elements.

20. The method of claim 14, wherein the engaging a light operation interface comprises engaging a touch screen display to direct movement of the plurality of lighting elements.

21. The method of claim 14, wherein the engaging a light operation interface comprises moving an aiming device to direct movement of the plurality of lighting elements.

22. The method of claim 14, wherein the engaging a light operation interface comprises:

detecting a position of a locating device, and controlling movement of the plurality of lighting elements based on the detected position of the locating device.

23. The method of claim 14, wherein the engaging a light operation interface comprises:

detecting a position and motion of a physiological structure, and controlling movement of the plurality of lighting elements based on the detected position and motion of the physiological structure.

* * * * *